US005704376A

United States Patent [19]

Ogunro

[11] Patent Number: 5,704,376

[45] Date of Patent: Jan. 6, 1998

[54] STRAND-SEPARATING APPARATUS

[76] Inventor: E. Olayinka Ogunro, 2727 Bolton Boone, #105, DeSoto, Tex. 75115

[21] Appl. No.: 745,427

[22] Filed: Nov. 12, 1996

[51] Int. Cl.[6] ..... A45D 8/34; A45D 24/34

[52] U.S. Cl. ..... 132/213.1; 132/210; 132/139; 132/161

[58] Field of Search ..... 132/213, 213.1, 132/214, 210, 124, 126, 139, 140, 144, 148, 161, 270, 106, 200

[56] References Cited

U.S. PATENT DOCUMENTS

| | | | |
|---|---|---|---|
| 302,734 | 7/1884 | Jobson . | |
| 938,040 | 10/1909 | Cladwell | 132/148 |
| 3,192,934 | 7/1965 | Catania | 132/136 |
| 3,368,569 | 2/1968 | Lawrence | 132/116 |
| 3,696,823 | 10/1972 | Dannat | 132/122 |
| 4,108,186 | 8/1978 | Esposto | 132/124 |
| 4,566,145 | 1/1986 | Wachtel | 132/144 |
| 4,566,472 | 1/1986 | Mueller et al. | 132/112 |
| 4,815,484 | 3/1989 | Stevenson | 132/161 |
| 4,993,438 | 2/1991 | Hunt | 132/139 |
| 5,240,017 | 8/1993 | Terwilliger | 132/145 |
| 5,626,153 | 5/1997 | Petrarca | 132/144 |

FOREIGN PATENT DOCUMENTS

| | | | |
|---|---|---|---|
| 449898 | 9/1927 | Germany | 132/148 |
| 615970 | 1/1949 | United Kingdom | 132/140 |

*Primary Examiner*—Todd E. Manahan
*Attorney, Agent, or Firm*—John A. Thomas

[57] ABSTRACT

An apparatus to separate hair into units of three for braiding, producing several such units in one application, comprises a handle and a platform affixed thereto having an upper shelf and anchor. The anchor has comb-like teeth for fixing the device to the hair of the subject. The upper shelf prevents tangling of unbraided hair above the device. A blade fixed perperdicularly to the platform has a plurality of teeth separated by notches of alternating depths which receive strands of hair. A lower shelf affixed at an angle to the blade acts as a support for the separated hair strands and prevents tangling. The width between braids may be varied by providing teeth of different widths on the blade.

5 Claims, 2 Drawing Sheets

STRAND-SEPARATING APPARATUS

BACKGROUND

This invention relates to an apparatus for separating strands of hair, so as to facilitate braiding. Some modern hair styles rely on weaving small braids over the entire scalp and thus require considerable time and labor. The prior art discloses many inventions directed to mechanizing the task of braiding hair. Generally these are complex machines intended to completely mechanize the task of braiding. Such machines will be complicated to manufacture, and thus relatively expensive in the retail hair-care market. The present invention solves this problem by helping the braider initially measure and equally divide the strands of hair to braided. Generally, braiders work with at least three strands of hair. The present invention allows the human braider to separate the hair into units of three strands faster and more accurately than by hand, yet it is simple to manufacture and operate. It may be used to assist the braiding of natural hair, or the weaving of strands of artificial hair into natural hair. Further, the apparatus may be safely used by young children to braid hair, including doll hair.

SUMMARY

The foregoing and other objects of the invention are accomplished by separating the hair into units of three for braiding. The invention produces several such units in one application. The preferred embodiment comprises a platform having a shelf and an anchor. The anchor has comb-like teeth for fixing the device to the hair of the subject, usually starting near the crown of the head. The shelf portion of the platform prevents tangling of unbraided hair above the device. A blade, fixed perpendicularly to the platform, has a plurality of teeth separated by notches of alternating depths. The operator presses strands of hair into these notches, and each group of three adjacent notches then holds a unit of three hair strands for braiding. A second shelf is fixed to the platform at an angle. This second shelf acts as a support for the separated hair strands and allows them to be more easily collected by the operator, and further prevents tangling with the remaining unbraided hair below the device. The width between braids may be varied by providing teeth of different spacings on the blade.

DRAWINGS

DETAILED DESCRIPTION

Figure 1:
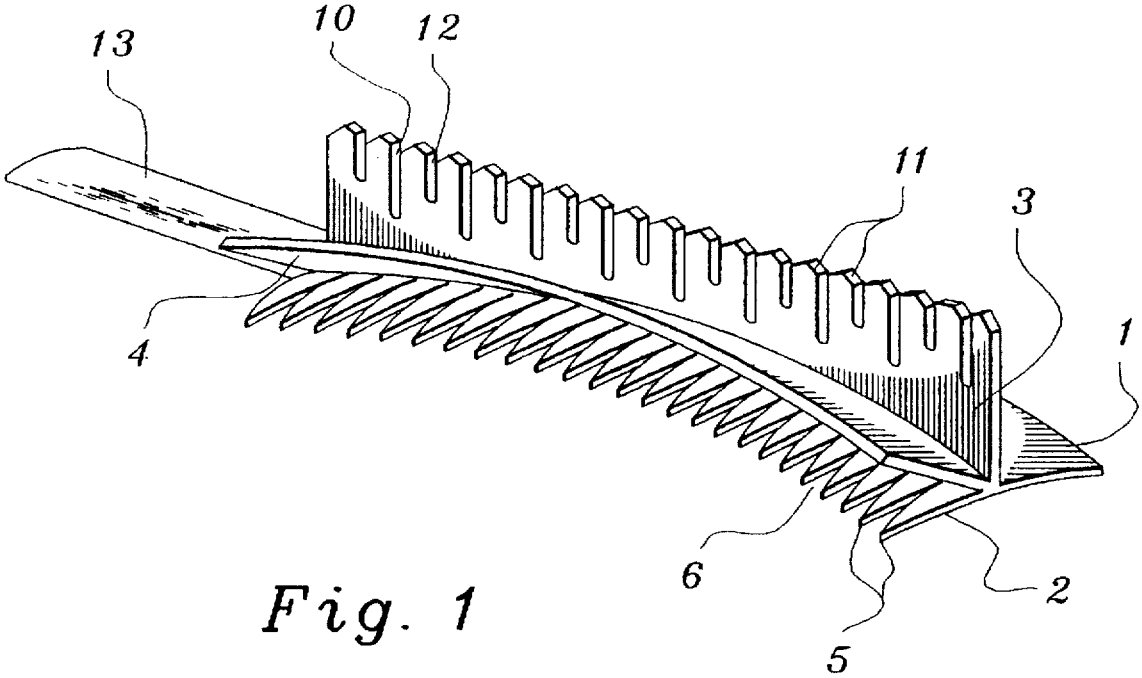
FIG. 1 is an isometric view of the preferred embodiment of the invention.

FIG. 1 is an isometric view of the preferred embodiment of the invention. The preferred embodiment has an upper shelf 1 and a anchor 2 fixed together longitudinally in approximately a co-planar relationship. A blade 3 is fixed perpendicularly to the shelf 1 and and the anchor 2, as shown. The blade 3 comprises first teeth 11 separated by first notches 10 and 12 of alternating depth. The anchor 2 comprises second teeth 5 separated by second notches 6. The second notches 6 have widths varying from wide to narrow from the distal edge of the anchor 2 to its proximal edge. A lower shelf 4 is fixed to the joint between shelf 1 and anchor 2 and the blade 3. The lower shelf 4 is disposed in a plane having approximately a 45 degree angle between the blade 3 and the anchor 2, although the angle is not critical. A handle 3 is fixed to the preferred embodiment along its longitudinal axis.

The preferred embodiment may be made from any suitable material, such as plastic, wood or metal, or any combination thereof.

Figure 2:
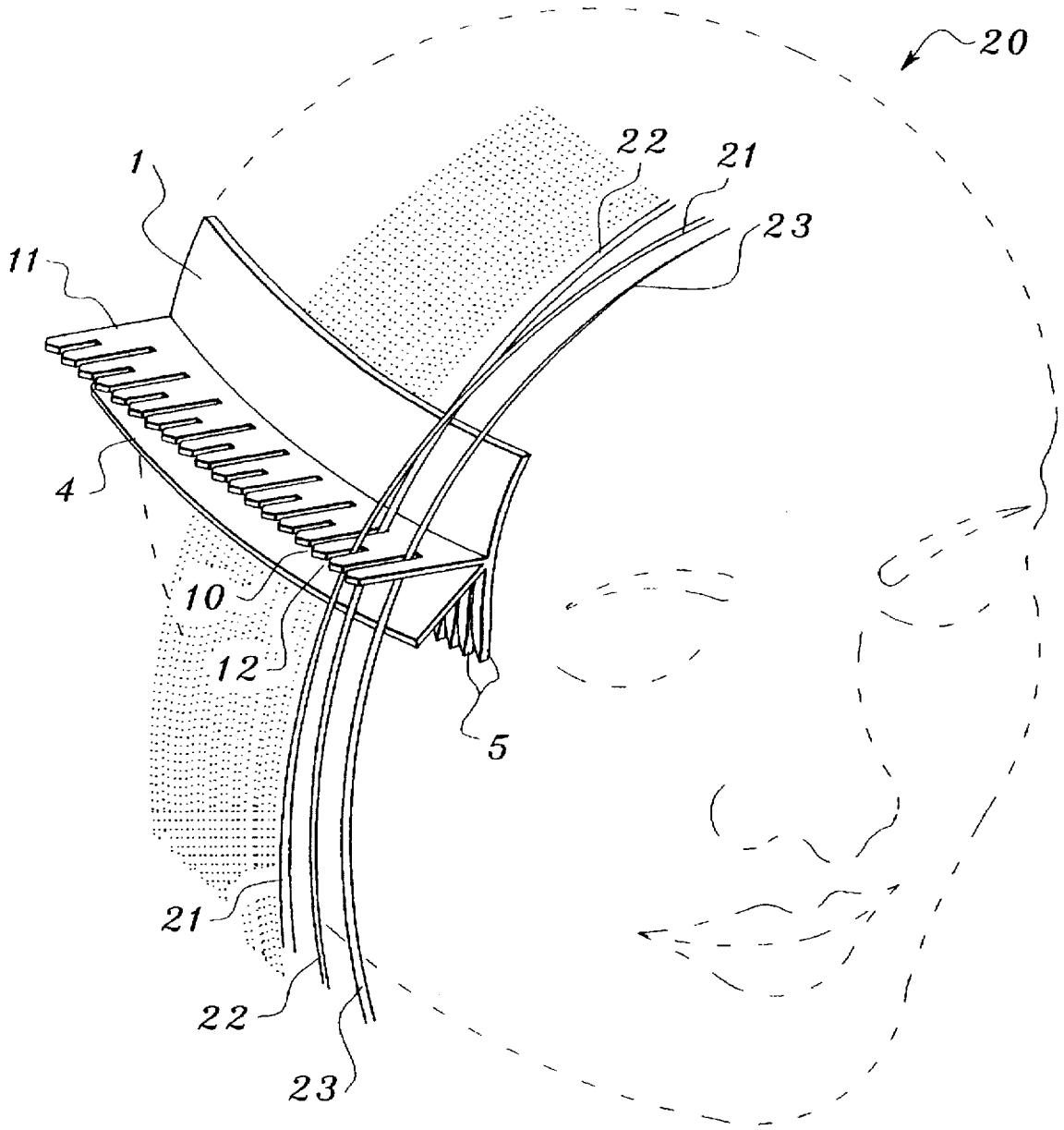
FIG. 2 is an isometric view of the device positioned on a human head.

FIG. 2 shows how the preferred embodiment is used to facilitate braiding of hair on a human head 20. The preferred embodiment is placed against the head 20 so that the upper shelf 1 lies more or less flat against the head 20, and the second teeth 5 of the anchor 2 engage the hair, holding the device firmly against the head 20. Although the anchor 2 appears to be a comb, it functions as an anchor to hold the device against the head. The device is placed against the head 20 so that a layer of hair falls across it.

FIG. 1 shows three strands of hair 21, 22, and 23, placed through three first notches 10 and 12, these being two deep first notches 10 and one shallow first notch 12, in the blade 3. Similarly, other strands of hair are selected by the operator and placed in the remaining first notches 10 and 12 of blade 3.

By this means a layer of hair above the upper shelf 1 may be rapidly separated into units of three strands 21, 22, and 23 as shown in FIG. 2. The deep first notches 10 and the shallow first notches 12 separate the strands 21, 22, and 23 from one another into two rows so that they may be easily grasped for braiding.

The lower shelf 4 holds the strands 2, 22, and 23 away from the remaining hair below the device, and thereby keeps them from tangling with the unbraided hair.

When all of the separated units of strands have been braided, the device can be moved lower on the head 20, below another layer of hair, and the process repeated as desired.

The reader will see that the number of braids which can be produced depends on the number of groups of three notches which are disposed along the blade 3. Also, the spacing between the braids may be determined by the width of the first teeth 11 in the blade 3. For example, and by way of illustration only, if the width of the first notches 10 and 12 is constant at 3.18 mm (⅛"), then the following table shows how spacing between the braids is determined by the width of the teeth 11 in blade 3:

| Tooth width | gives braids |
|---|---|
| 6.4 mm (¼") | 28.6 mm (1⅛") |
| 9.5 mm (⅜") | 38.1 mm (1½") |
| 12.7 mm (½") | 47.6 mm (1⅞") |
| 19.1 mm (¾") | 66.7 mm (2⅝") |

In the embodiment shown in FIG. 1, the preferred embodiment is shown having a slight curve in both its longitudinal and transverse axes. This curve better fits the device to the shape of the subject's head, but its presence is not essential to the function of the invention. The edge of blade 3 as defined by the distal ends of the first teeth 11, is shown curved in FIG. 1, but the distal ends of the first teeth 11 could also define a straight line without altering the function of the device. The same holds true for the edge of the anchor 2, as defined by the distal ends of the second teeth 5.

The reader will see that the need for a way to speed up hair braiding and make it more regular has been met by the present invention, as described above. Since certain changes could be made in the embodiment of the invention described above without departing from the spirit and scope of the invention, I intend that all matter contained in the foregoing description and drawings shall be interpreted as illustrative and not in a limiting sense. The reader should understand that the following claims are intended to cover all of the generic and specific features of the invention herein described and all statements of the scope of the invention which might be interpreted to fall between these features.

I claim:

1. An apparatus for separating hair into substantially equal strands for braiding comprising:

(a) an upper shelf, (b) an anchor longitudinally connected to the upper shelf and substantially co-planar therewith, (c) a blade disposed in a plane perpendicular to the upper shelf and the anchor and longitudinally connected thereto, (d) a lower shelf disposed between the blade and the anchor, and connected longitudinally to the blade and the upper shelf and the anchor, (e) a handle connected to the upper shelf, the lower shelf, the anchor, and the blade, (f) means integral with the blade for separating hair into substantially equal strands; and, (g) means integral with the anchor for gripping hair.

2. The apparatus of claim 1 wherein the upper shelf and the anchor are curved along their longitudinal and transverse axes so as to more closely fit the shape of a human head.

3. The apparatus of claim 1 wherein the means for separating hair into substantially equal strands comprises the blade having first teeth; the first teeth being alternately separated by first notches, the first notches having alternating deep and shallow depths, and the blade having a number of first notches equal to a multiple of three.

4. The apparatus of claim 1 wherein the means for gripping hair comprises the anchor having second teeth, the second teeth being equally spaced by second notches; the second notches being wider at their distal ends than their proximal ends.

5. An apparatus for separating hair into substantially equal strands for braiding comprising:

(a) an upper shelf, (b) an anchor longitudinally connected to the upper shelf and substantially co-planar therewith, (c) a blade disposed in a plane perpendicular to the upper shelf and the anchor and longitudinally connected thereto, (d) a lower shelf disposed between the anchor and the blade, and connected longitudinally to the blade and the upper shelf and the anchor, (e) a handle connected to the upper shelf, the lower shelf, the anchor, and the blade;

(f) the blade having first teeth; the first teeth being alternately separated by first notches, the notches having alternating deep and shallow depths; the blade having a number of first notches equal to a multiple of three;

(g) the anchor having second teeth, the second teeth being equally spaced by second notches; the second notches being wider at their distal ends than their proximal ends; and, (h) the upper shelf and the anchor are curved along their longitudinal and transverse axes so as to more closely fit the shape of a human head.

* * * * *